US008909427B2

(12) United States Patent
Lim et al.

(10) Patent No.: US 8,909,427 B2
(45) Date of Patent: Dec. 9, 2014

(54) CONTROL SYSTEM FOR ROTATING SHAFT

(75) Inventors: Yong-Seob Lim, Changwon (KR); Seung-Jin Choi, Changwon (KR); Min-Sig Kang, Seongnam-si (KR)

(73) Assignee: Samsung Techwin Co., Ltd., Seongnam-si (KR)

( * ) Notice: Subject to any disclaimer, the term of this patent is extended or adjusted under 35 U.S.C. 154(b) by 211 days.

(21) Appl. No.: 13/608,423

(22) Filed: Sep. 10, 2012

(65) Prior Publication Data

US 2013/0068584 A1 Mar. 21, 2013

(30) Foreign Application Priority Data

Sep. 19, 2011 (KR) ..... 10-2011-0094279

(51) Int. Cl.

| | |
|---|---|
| ***A01B 69/00*** | (2006.01) |
| ***B62D 6/00*** | (2006.01) |
| ***F16D 23/10*** | (2006.01) |
| ***F16D 43/06*** | (2006.01) |
| ***F41G 5/24*** | (2006.01) |
| ***F41G 3/22*** | (2006.01) |
| ***F41A 27/30*** | (2006.01) |
| ***F41G 3/16*** | (2006.01) |
| ***F41G 5/16*** | (2006.01) |

(52) U.S. Cl.

CPC *F41G 3/165* (2013.01); *F41G 5/24* (2013.01); *F41G 3/22* (2013.01); *F41A 27/30* (2013.01); *F41G 5/16* (2013.01)

USPC ..... 701/42; 701/1; 701/41; 192/103 R

(58) Field of Classification Search

USPC ..... 701/1, 41, 42; 192/103 R

See application file for complete search history.

(56) References Cited

U.S. PATENT DOCUMENTS

| | | | | |
|---|---|---|---|---|
| 5,729,111 | A | 3/1998 | Ogura et al. | |
| 5,791,425 | A * | 8/1998 | Kamen et al. | 180/7.1 |
| 5,971,091 | A * | 10/1999 | Kamen et al. | 180/218 |
| 7,966,113 | B2 * | 6/2011 | Kroehnert et al. | 701/41 |
| 2003/0173928 | A1 | 9/2003 | Hagihara et al. | |

(Continued)

FOREIGN PATENT DOCUMENTS

| | | | |
|---|---|---|---|
| KR | 0163638 | B1 | 3/1999 |
| KR | 100842978 | B1 | 7/2008 |
| KR | 1020100085730 | A | 7/2010 |

OTHER PUBLICATIONS

Byoung-Uk Nam, et al, "Optimal Speed Controller Design of the Two-Inertia Stabilization System", World Academy of Science, Engineering and Technology 41, 2008, 6 pages.

*Primary Examiner* — James Trammell
*Assistant Examiner* — Majdi Alsomiri
(74) *Attorney, Agent, or Firm* — Sughrue Mion, PLLC

(57) ABSTRACT

A rotating element control system includes a rotating element rotatably disposed on a main body, a first measuring unit which measures an angular movement of the main body, a driving unit which drives the rotating element, a second measuring unit which measures a rotational speed of the rotating element, a transfer unit which connects the rotating element and the driving unit and transfers a driving force to the rotating element, a motion compensation unit which generates a compensation signal which removes an error component generated by the angular movement of the main body, and a stabilization control unit which controls the driving unit based on the compensation signal and a difference between an input signal and the rotational speed of the rotating element.

16 Claims, 8 Drawing Sheets

(56) References Cited

U.S. PATENT DOCUMENTS

2005/0197994 A1* 9/2005 Fujii et al. ..... 706/59
2007/0050139 A1* 3/2007 Sidman ..... 701/220
2007/0095593 A1* 5/2007 Peterson et al. ..... 180/248
2009/0037054 A1* 2/2009 Igarashi et al. ..... 701/42
2010/0079101 A1* 4/2010 Sidman ..... 318/649

* cited by examiner

CONTROL SYSTEM FOR ROTATING SHAFT

CROSS-REFERENCE TO RELATED PATENT APPLICATIONS

This application claims priority from Korean Patent Application No. 10-2011-0094279, filed on Sep. 19, 2011, in the Korean Intellectual Property Office, the disclosure of which is incorporated herein by reference in its entirety.

BACKGROUND

1. Field

Apparatuses and methods consistent with exemplary embodiments relate to a rotating shaft control system, and more particularly, to a rotating shaft control system having an improved degree of accuracy in terms of stability by reducing influence of a rotational motion of a main body transferred to a mechanical system.

2. Description of the Related Art

A remote control weapon station (RCWS) is a system that enables precise shooting on a target by adjusting a weapon from a remote place to prevent a gunner from being exposed to the outside when performing a battle operation at a near or far distance. The RCWS is mounted on a variety of vehicles such as unmanned vehicles, unmanned armored vehicles, unmanned planes, unmanned patrol boats, etc.

Since a gunner located at a remote place from an RCWS performs shooting by adjusting a target shooting point of a weapon, a direction of the weapon of the RCWS needs to be rapidly and accurately controlled.

Korean Patent Publication No. 2010-0101915 discloses technology relating to a control system for an RCWS, in which an error signal due to a difference between an output speed and an input speed of a driving unit is used for compensating for a frictional force. However, since the control system considers only a frictional force generated from inside the RCWS, an amount of a motion of a vehicle equipped with the RCWS and driving of a rotating shaft according to a speed command instructed by an operator are not free from influence of various frictional disturbances generated by mechanical constituent elements of the RCWS.

SUMMARY

One or more exemplary embodiments may overcome the above disadvantages and other disadvantages not described above. However, it is understood that one or more exemplary embodiment are not required to overcome the disadvantages described above, and may not overcome any of the problems described above.

One or more exemplary embodiments provide a rotating shaft control system having an improved degree of accuracy in terms of stability by reducing influence of a rotational motion of a main body transferred to a mechanical system.

One or more exemplary embodiments also provide a rotating shaft control system having a function to effectively remove an error component generated when a rotational motion of a main body is transferred to a mechanical system.

According to an aspect of an exemplary embodiment, a rotating element control system includes a rotating element rotatably disposed on a main body, a first measuring unit for measuring an angular motion of a rotation of the main body, a driving unit which drives the rotating element, a second measuring unit which measures a rotational speed of the rotating element, a transfer unit which connects the rotating element and the driving unit and transfers a driving force to the rotating element, a motion compensation unit which generates a compensation signal which removes an error component generated by the angular acceleration of the main body, and a stabilization control unit which controls the driving unit based on the compensation signal and a difference between a stabilization input signal and the rotating shaft speed sensed by the second sensing unit.

The angular acceleration of the main body measured by the first sensing unit can be an angular acceleration, and the transfer unit may transfer the driving force to the rotating element at a gear ratio. The compensation signal may include a compensation torque signal $T_m$ calculated according to an equation $T_m=-(N-1)J_m\,\alpha_h$, to offset an error generated as a rotational force of the main body rotating at the angular acceleration $\alpha_h$ is transferred to the transfer unit having the gear ratio N and the driving unit having the rotational inertia mass $J_m$.

The stabilization control unit may include at least of a proportional controller, an integral controller, and a derivative controller.

The stabilization control unit may include an integral controller for integrating the difference between the rotational speed of the rotating element and the input signal and a proportional-derivative controller receiving the rotational speed of the rotating element as an input.

BRIEF DESCRIPTION OF THE DRAWINGS

The above and other aspects will become more apparent by describing in detail exemplary embodiments thereof with reference to the attached drawings in which.

DETAILED DESCRIPTION

Figure 1A:
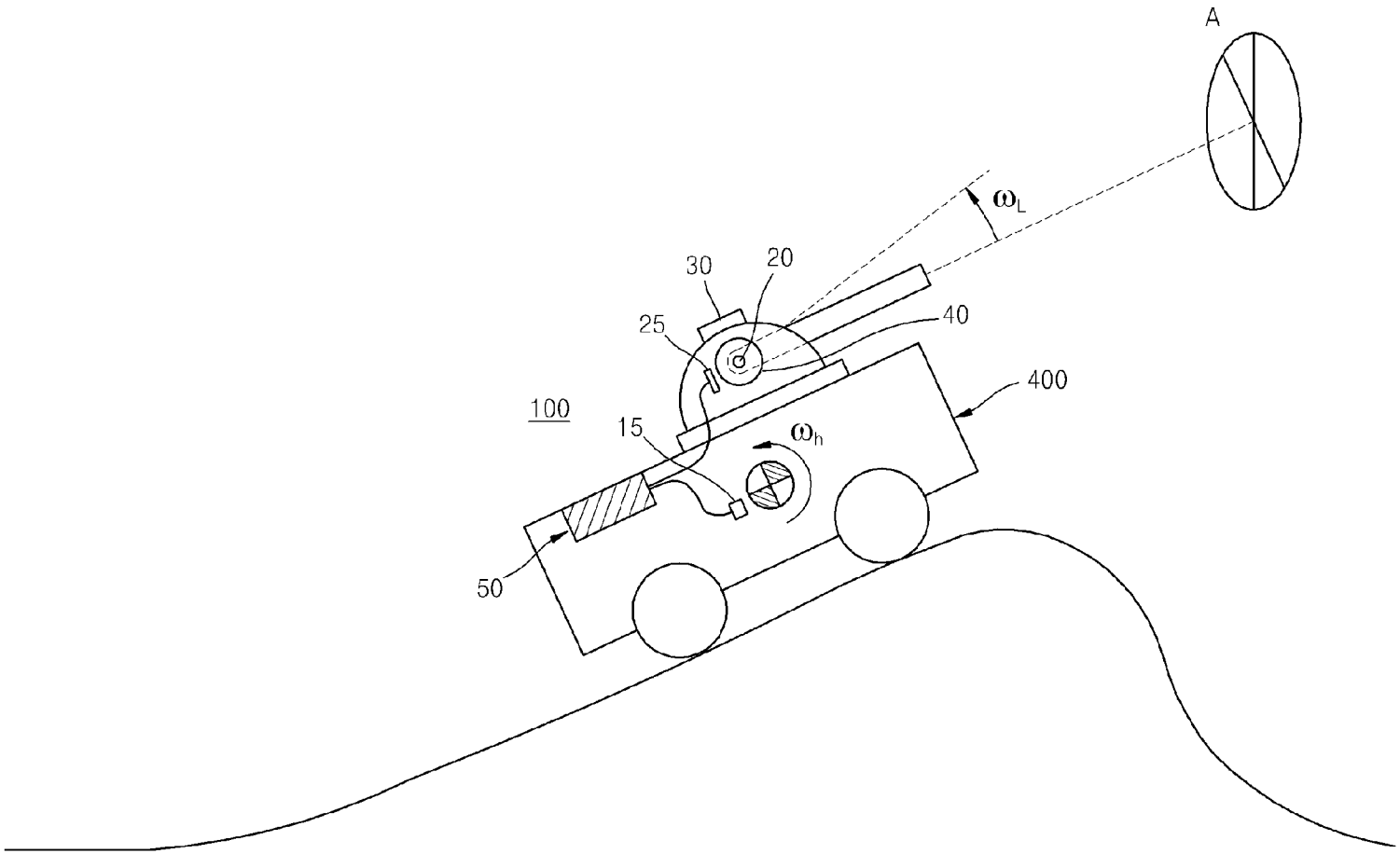
FIG. 1A is a conceptual view schematically illustrating an operational state of an RCWS having a rotating shaft control system according to an exemplary embodiment.

Hereinafter, exemplary embodiments will be described in detail with reference to the attached drawings. Like reference numerals in the drawings denote like elements.

FIG. 1A is a conceptual view schematically illustrating an operational state of a remote control weapon station (RCWS) having a rotating shaft control system according to an exemplary embodiment. Referring to FIG. 1A, the rotating shaft control system according to the present embodiment is used to control driving of an RCWS 100 and includes a rotating shaft 20 rotatably installed on a main body 400, a driving unit 30 for driving the rotating shaft 20, a first sensing unit 15 for sensing an angular acceleration of a rotation of the main body 400, a second sensing unit 25 for sensing a rotational speed of the rotating shaft 20, a transfer unit 40 for transferring a driving force by connecting the rotating shaft 20 and the driving unit 30, and a control unit 50.

Although in FIG. 1A the main body 400 where the RCWS 100 is installed is a vehicle, the exemplary embodiments is not limited thereto and the RCWS 100 may be installed on any moving device, for example, a ship, a patrol boat, an unmanned scout robot, etc.

Referring to FIG. 1A, the main body 400 equipped with the RCWS 100 is capable of moving toward a target point A and performing sensing and shooting on the target point A with the rotating shaft 20 of the RCWS 100 rotating at a rotational speed $\omega_L$ while the main body 400 is moving. Since the main body 400 rotates at a rotational speed $\omega_h$ according to a terrain through which the main body 400 travels, a rotational motion generated by the main body 400 may have an influence on control of the RCWS 100.

Disturbance motions of the main body 400 forming a platform for installing the RCWS 100 may be generally divided into two types: an azimuth or yaw motion and an elevation or pitch motion. A motion related to the rotational speed $\omega_h$ in FIG. 1A corresponds to an elevation motion. In FIG. 1A, a rotational motion in only an elevation direction is illustrated for convenience of explanation.

In order to measure the rotational speed $\omega_h$ related to a motion in the elevation direction, instead of directly attaching a sensor to the main body 400, sensors installed to control the RCWS 100, that is, a gyro sensor and an encoder, are used to obtain a signal directly or indirectly indicating a yaw motion and an elevation motion.

First, it is simple to obtain an angular speed of a motion of the main body 400 in the elevation direction acting as a disturbance in the elevation (or pitch) direction. That is, a pitch angular speed of a gyro sensor installed on the RCWS 100 is used as it is.

In FIG. 1A, the first sensing unit 15 installed on the RCWS 100 corresponds to a gyro sensor for sensing an angular speed of the main body 400. The gyro sensor installed on the RCWS 100 can be used because the main body 400 and the RCWS 100 form a single body by using a coupling device such as a bolt. Thus, a pitch disturbance of the main body 400 is the same as a pitch angular speed of the RCWS 100. Since an angular acceleration $\alpha_h$ of a rotation of the main body 40 is obtained by differentiating an angular speed of the main body 400 sensed by the first sensing unit 15, the angular acceleration $\alpha_h$ may be obtained by using the first sensing unit 15.

Second, obtaining an angular speed of the main body 400 in a yaw direction acting as a disturbance in the yaw direction is slightly complicated compared to the obtaining of a pitch disturbance. A yaw-direction encoder 15*b* (see FIG. 1B) installed on the RCWS 100 may be used to measure an angular speed in the yaw direction.

Figure 1B:
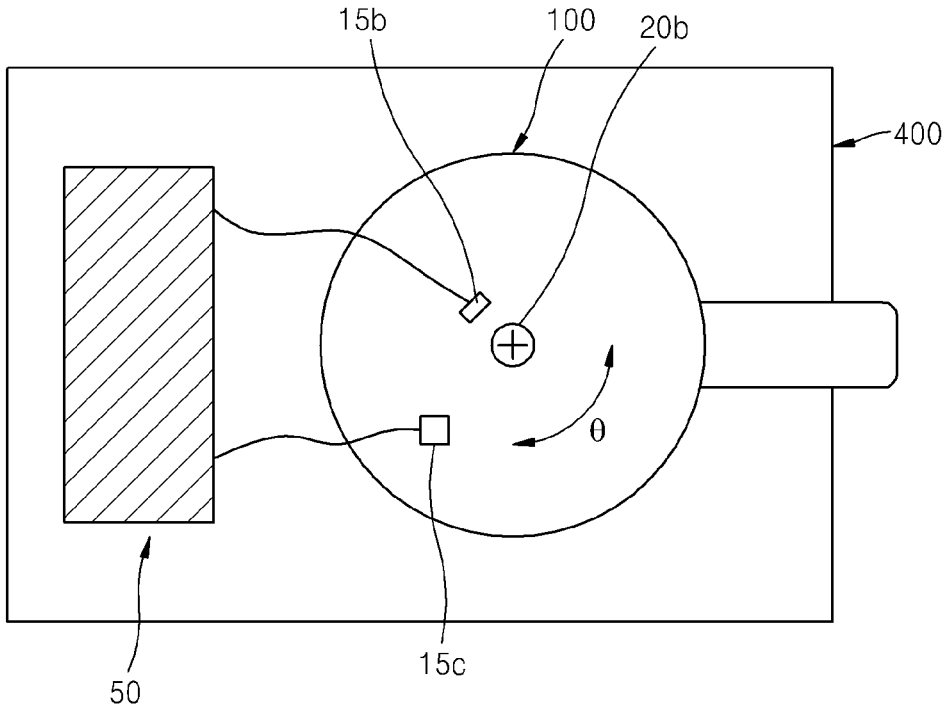
FIG. 1B is a conceptual view schematically illustrating a motion of the rotating shaft control system of FIG. 1A in a yaw direction.

FIG. 1B is a conceptual view schematically illustrating a motion of the rotating shaft control system of FIG. 1A in the yaw direction. In FIG. 1B, the illustration of some of constituent elements of FIG. 1A is omitted for convenience of illustration and only constituent elements related to the motion of the RCWS 100 in the yaw direction are illustrated.

The RCWS 100 may be installed to be rotatable in a direction indicated by θ (yaw direction) with respect to the main body 400. A motion of the RCWS 100 rotating in the direction θ is called a yaw motion. In order to sense a rotational motion of the RCWS 100 in the yaw direction, the yaw-direction encoder 15*b* and a yaw-direction gyro sensor 15*c* may be arranged on the RCWS 100. The control unit 50 may receive signals from the yaw-direction encoder 15*b* and the yaw-direction gyro sensor 15*c*.

The main body 400 and the RCWS 100 are not integrally coupled to rotate in the yaw direction. The RCWS 100 is installed to be rotatable in the yaw direction with respect to the main body 400 via a rotation gear (not shown) and a rotation bearing (not shown). Thus, the RCWS 100 and the main body 400 may rotate in different directions.

An angular speed in the yaw direction that is a disturbance in the yaw direction of the main body 400 may be indirectly obtained by using two sensors, that is, the yaw-direction encoder 15*b* and the yaw-direction gyro sensor 15*c*, installed on the RCWS 100. In other words, an angular speed in the yaw direction of the main body 400 may be obtained by subtracting a rotational angular speed of the RCWS 100, that is, a differential value of a yaw-direction encoder angular signal, from a yaw-direction gyro angular speed of the RCWS 100 rotatably mounted on the main body 400. This may be simply expressed as follows:

$$W_{z,h}=W_{z,gyro}-W_{z,enc} \quad \text{[Equation 1]}$$

In Equation 1 above, "$W_{z,h}$" denotes a yaw-direction disturbance angular speed of a vehicle, "$W_{z,gyro}$" denotes a yaw-direction gyro angular speed mounted on the main body 400 of the RCWS 100, and "$W_{z,enc}$" denotes a rotational angular speed of the RCWS 100 itself, that is, a differential value of an encoder angular signal of the yaw-direction encoder 15*b*.

Figure 2:
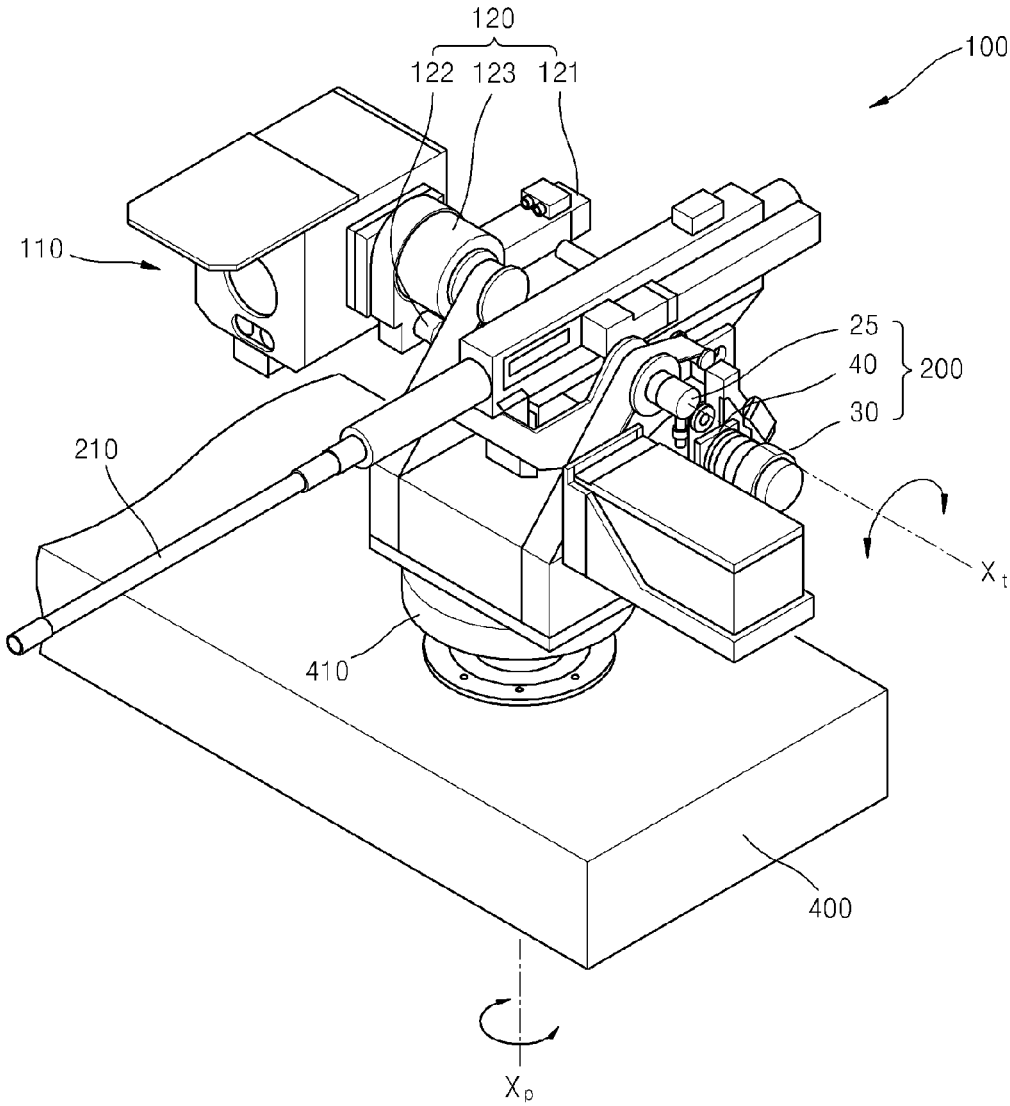
FIG. 2 is a perspective view illustrating an example of the RCWS of FIG. 1A.

FIG. 2 is a perspective view illustrating an example of the RCWS 100 of FIG. 1A. The RCWS 100 may include a weapon unit 200 and an imaging unit 110. The imaging unit 110 captures an image including a target (not shown). The weapon unit 200 shoots on the target.

The imaging unit 110 is coupled to the weapon unit 200 via an imaging unit driving unit 120. The imaging unit 110 captures an input image and may measure a target distance corresponding to a distance from the weapon unit 200 to the target. The imaging unit driving unit 120 may rotate the imaging unit 110 around at least one axis.

The imaging unit 110 may include a day-time camera (not shown), a night-time camera (not shown), and a rangefinder (not shown). The day-time camera may capture a day-time image and the night-time camera may capture a night-time image. The rangefinder may measure a target distance.

The imaging unit driving unit 120 may include an imaging unit driving motor 121, an encoder 122, and a decelerator 123. The imaging unit driving motor 121 provides a driving force to rotate the image unit 110 in at least one direction. The encoder 122 detects an amount of rotation of the imaging unit 110. The decelerator 123 decelerates rotation of the imaging unit driving motor 121.

The weapon unit 200 may include a shooting unit 210 that shoots on the target. The shooting unit 210 may be a gun or artillery capable of firing toward the target.

The driving unit 30 of the weapon unit 200 may rotate the shooting unit 210 around a first axis $X_t$. The weapon unit 200 may include the driving unit 30 for generating a rotational driving force, the transfer unit 40 for transferring the rotational driving force of the driving unit 30 to the rotating shaft 20 of FIG. 1A, and the second sensing unit 25 for sensing the rotational speed $\omega_L$ of the rotating shaft 20.

The driving unit 30 generates a driving force to rotate the shooting unit 210 around at least the first axis $X_t$. The second sensing unit 25 senses a rotational speed of the shooting unit 210. The transfer unit 40 decelerates rotation of the driving unit 30.

The shooting unit 210 of the weapon unit 200 is rotatably installed on the main body 400 via the rotating shaft 20 of FIG. 1A. Also, the weapon unit 200 may be coupled to the main body 400 to be capable of rotating around a second axis $X_p$ in a vertical direction via a horizontal rotation driving unit 410.

According to the RCWS 100 configured as above, the shooting unit 210 may sense the target and perform shooting while performing a tilting motion (elevation motion) by rotating around the first axis $X_t$ and a panning motion (yaw motion?) by rotating around the second axis $X_p$.

Referring to FIG. 1A, the RCWS 100 may include the first sensing unit 15 to sense the rotational speed $\omega_h$ of a rotation of the main body 400. Since the present embodiment is not limited to the above arrangement position of the first sensing unit 15, the first sensing unit 15 may be embodied by installing a separate sensor on the main body 400.

Shaking of the main body 400 may instantly cause an abrupt change in replacement of the RCWS 100. The driving unit 30 generates power to make the RCWS 100 aim at the target while the main body 400 travels around a tough terrain such as a mountainous area to perform target sensing and shooting jobs. The power generated by the driving unit 30 can stabilize the RCWS 100, that is, a load.

The rotating shaft control system according to the present embodiment is a system adopting a stabilization control algorithm for stabilizing a control operation of the RCWS 100 based on an analysis formed by a mechanical driving mechanism. Such a rotating shaft control system may improve a target aiming ability.

Although following description discusses the stabilization based on an analysis formed by the mechanical driving mechanism around the first axis $X_t$, the rotating shaft control system of the exemplary embodiments is not limited thereto. For example, the rotating shaft control system may be applied to control of a rotational motion of the RCWS 100 around the second axis $X_p$ or control of a rotational motion of the imaging unit 110.

Figure 3:
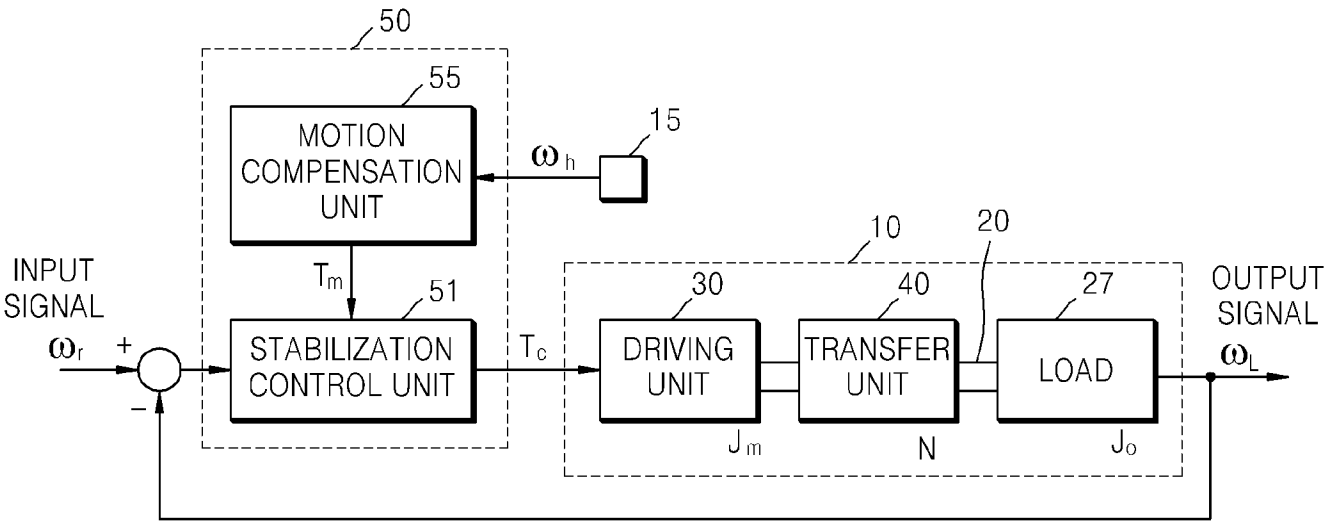
FIG. 3 is a block diagram illustrating constituent elements of a rotating shaft control system applied to the RCWS of FIG. 1A.

FIG. 3 is a block diagram illustrating constituent elements of the rotating shaft control system applied to the RCWS 100 of FIG. 1A. Referring to FIG. 3, the rotating shaft control system according to the present embodiment includes the rotating shaft 20 rotatably installed on the main body 400, the driving unit 30 for driving the rotating shaft 20, the first sensing unit 15 for sensing the angular acceleration $\alpha_h$ of a rotation of the main body 400, the second sensing unit 25 of FIG. 1A for sensing the rotational speed $\omega_L$ of the rotating shaft 20, the transfer unit 40 for connecting the rotating shaft 20 and the driving unit 30 and transferring a driving force, a motion compensation unit 55 for generating a compensation signal to compensate for an influence by the rotational speed $\omega_h$ of the main body 400 and a stabilization control unit 51 for controlling the driving unit 30 based on a compensation torque signal $T_m$ and a difference between the rotational speed $\omega_L$ of the rotating shaft 20 and an input signal $\omega_r$ input to the stabilization control unit 51 for controlling the driving unit 30.

The motion compensation unit 55 and the stabilization control unit 51 form the control unit 50 for controlling driving of a mechanical system 10 formed by the driving unit 30, the transfer unit 40, the rotating shaft 20, and a load 27.

The control unit 50 may be embodied, for example, by a printed circuit board having various electronic parts and circuit patterns, by a semiconductor chip including software or circuits, or by software that is executable in a computer.

Also, each of the motion compensation unit 55 and the stabilization control unit 51 may be separately embodied in at least one form of a printed circuit board, a semiconductor chip, a part of circuits on a printed circuit board, and software.

Figure 4:
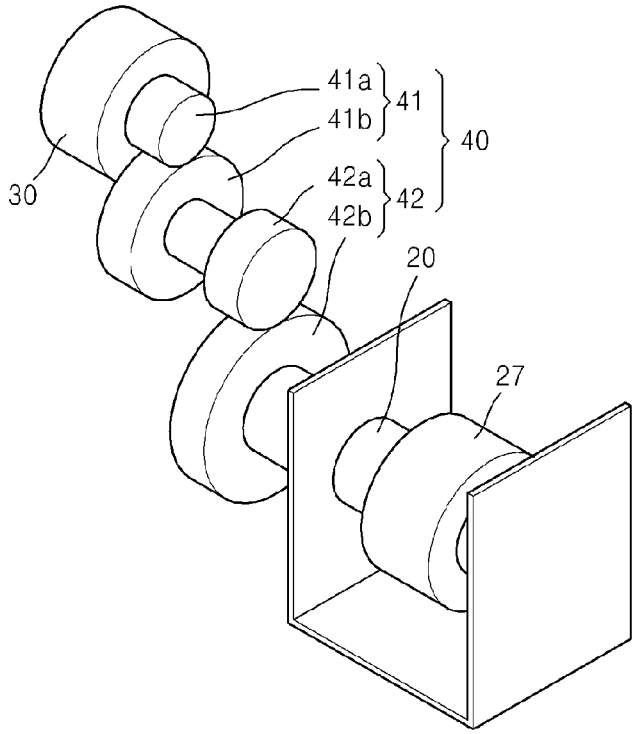
FIG. 4 is a perspective view schematically illustrating a structure of mechanical elements of the rotating shaft control system of FIG. 3.
Figure 5:
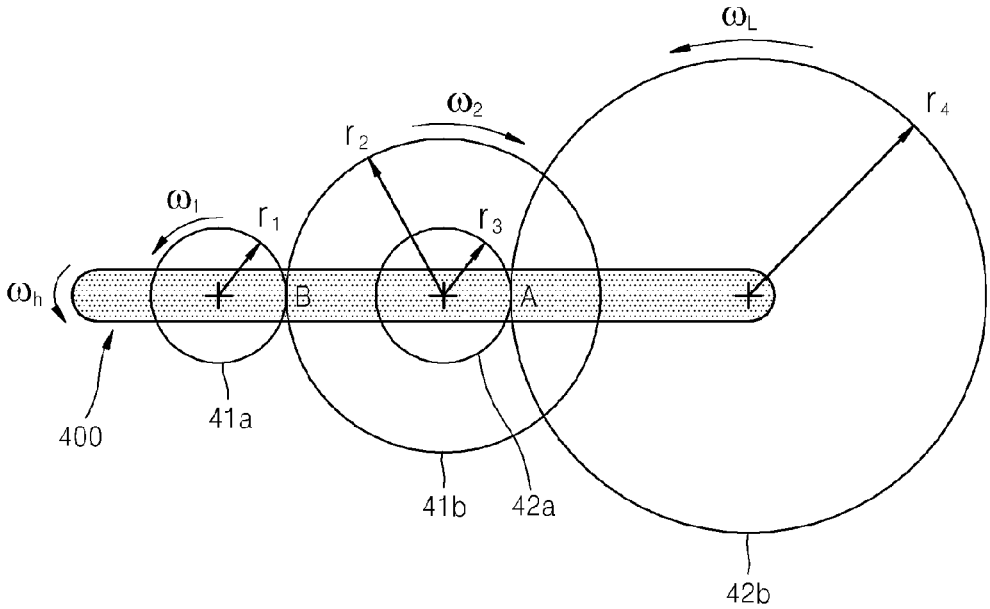
FIG. 5 is a view schematically illustrating a mechanical relationship among mechanical elements of FIG. 4.

FIG. 4 is a perspective view schematically illustrating a structure of mechanical elements of the rotating shaft control system of FIG. 3. FIG. 5 is a view schematically illustrating a mechanical relationship among mechanical elements of FIG. 4.

FIG. 4 schematically illustrates a coupling relationship of mechanical elements of the mechanical system 10 controlled by the control unit 50 in the rotating shaft control system of FIG. 3. In FIGS. 3 and 4, the load 27 denotes elements such as the shooting unit 210 rotated by the rotating shaft 20.

Referring to FIG. 5, it may be interpreted how the rotational speed $\omega_h$ of a vehicle, that is, the main body 400 affects the mechanical system 10 in stabilizing the load 27. In FIG. 5, tangential speeds at points A and B may be expressed by Equation 2 and 3 and a gear ratio of the overall mechanical system 10 may be expressed by Equation 4.

Referring to FIGS. 4 and 5, the transfer unit 40 that connects the driving unit 30 and the rotating shaft 20 of the load 20 comprises a first gear assembly 41 and a second gear assembly 42. Each of the first gear assembly 41 and the second gear assembly 42 comprises a plurality of gears 41*a*, 41*b*, 42*a*, and 42*b* that are connected to each other and rotate together.

$$\vec{v}_A=(r_4+r_3)\omega_h+r_3\omega_2=r_4\omega_L \quad \text{[Equation 2]}$$

$$\vec{v}_B=(r_4+r_3+r_2+r_1)\omega_h-r_1\omega_1=(r_4+r_3)\omega_h-r_2\omega_2 \quad \text{[Equation 3]}$$

$$N=\frac{r_2}{r_1}\frac{r_4}{r_3} \quad \text{[Equation 4]}$$

Equation 5 may be obtained by summarizing Equation 3 with respect to $\omega_2$.

$$r_2\omega_2=\frac{r_2r_4}{r_3}\omega_L-\frac{r_2(r_4+r_3)}{r_3}\omega_h \quad \text{[Equation 5]}$$

A rotational speed $\omega_1$ of the driving unit 30 may be obtained by developing Equation 6.

$$(r_2+r_1)\omega_h-r_1\omega_1=-\left[\frac{r_2r_4}{r_3}\omega_L-\frac{r_2r_4}{r_3}\omega_h-r_2\omega_h\right] \quad \text{[Equation 6]}$$

$$\omega_h-\omega_1=-\frac{r_2r_4}{r_1r_3}\omega_L+\frac{r_2r_4}{r_1r_3}\omega_h=-N\omega_L+N\omega_h$$

$$\therefore\ \omega_1=N\omega_L-(N-1)\omega_h$$

Figure 6:
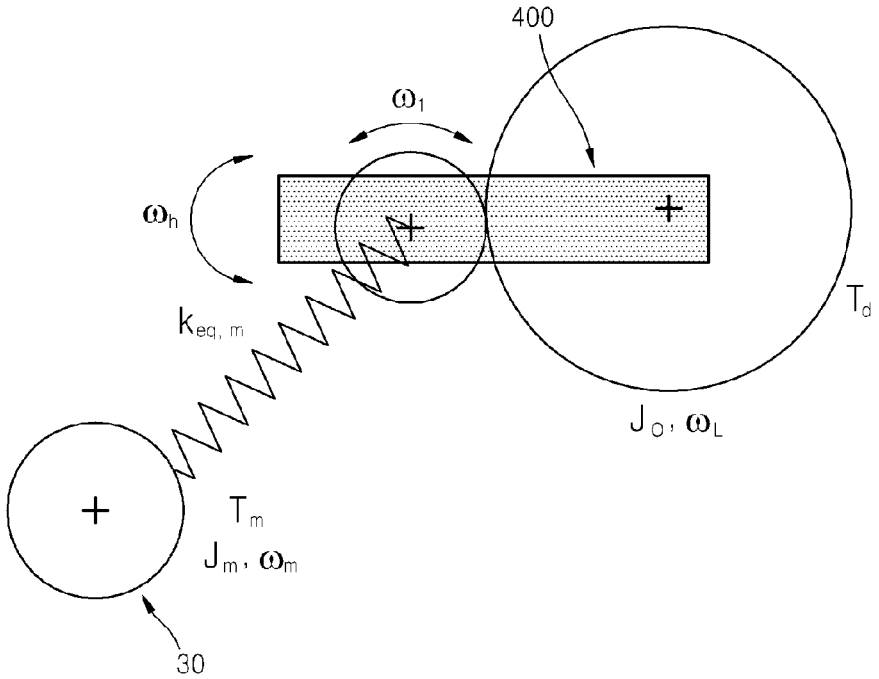
FIG. 6 is a conceptual view schematically illustrating a relationship of mechanical elements of FIG. 5 by using a physical model.

FIG. 6 is a conceptual view schematically illustrating a relationship of mechanical elements of FIG. 5 by using a physical model. Considering movement of the main body 400, a physical model of mechanical elements forming a mechanical system may be expressed by a two-mass system as illustrated in FIG. 6.

Referring to FIGS. 3 and 6, assuming that a rotational inertia mass of the driving unit 30 is $J_m$, a rotational inertia mass of the load 27 is $J_o$, an overall gear ratio of the transfer unit 40 is N, a compensation torque signal of the driving unit 30 is $T_m$, a torque of disturbance is $T_d$ (corresponding to a moment due to friction or imbalance), an overall torsional deformation spring constant of mechanical elements connecting the load 27 to the driving unit 30 is $k_{eq,m}$, the rotational angle of the driving unit 30 is $\theta_m$, a rotational angle of the load 27 is $\theta_L$, and a torsional rotational angle due to an error in consideration of overall angle due to the torsional deformation of the mechanical elements between the driving unit 30 and the load 27 is $\theta_1$, a motion equation such as Equations 7 and 8 may be established.

$$J_m\ddot{\theta}_m+k_{eq,m}(\theta_m-\theta_1)=T_m \quad \text{[Equation 8]}$$

$$J_o\ddot{\theta}_L+Nk_{eq,m}(\theta_1-\theta_m)=T_d \quad \text{[Equation 8]}$$

Also, Equation 9 may be obtained by integrating Equation 4 with respect to angular speeds to obtain an equation with respect to angles.

$$\theta_1=N\theta_L-(N-1)\theta_h \quad \text{[Equation 9]}$$

Equations 10 and 11 are obtained by substituting Equation 9 into Equations 7 and 8 and summarizing the same.

$$J_m\ddot{\theta}_m+K_{eq,m}\theta_m-NK_{eq,m}\theta_L=-K_{eq,m}(N-1)\theta_h+T_m \quad \text{[Equation 10]}$$

$$J_o\ddot{\theta}_L+N^2K_{eq,m}\theta_L-NK_{eq,m}\theta_m=K_{eq,m}N(N-1)\theta_h+T_d \quad \text{[Equation 11]}$$

Equations 12 and 13 are obtained by differentiating Equations 10 and 11 and summarizing the same.

$$J_m\dot{\omega}_m+K_{eq,m}\omega_m-NK_{eq,m}\omega_L=-K_{eq,m}(N-1)\omega_h+\frac{d}{dt}T_m \quad \text{[Equation 12]}$$

$$J_o\dot{\omega}_L+N^2K_{eq,m}\omega_L-NK_{eq,m}\omega_m=K_{eq,m}N(N-1)\omega_h+\frac{d}{dt}T_d \quad \text{[Equation 13]}$$

Figure 7:
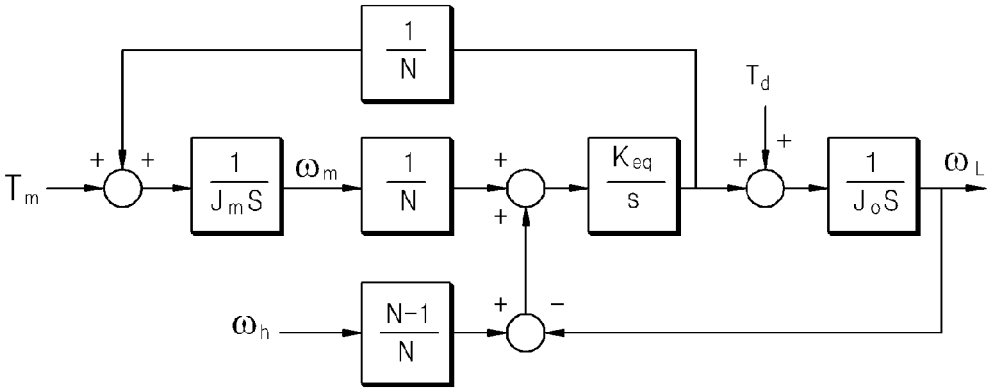
FIG. 7 is a block diagram illustrating a physical model of FIG. 6.

FIG. 7 is a block diagram illustrating a physical model of FIG. 6. The two-mass system of FIG. 6, which may be expressed by Equations 12 and 13, may be also expressed by the block diagram of FIG. 7.

As it may be seen from Equations 12 and 13 and the block diagram of FIG. 7, the RCWS 100 corresponding to the two-mass system may be stabilized through feedback control in which the angular speed (=that is, the rotational speed) $\omega_L$ of the rotating shaft 20 is fed back as an input of the control system. However, the rotational speed $\omega_h$ of the main body 400 has a negative impact on the physical model of the RCWS 100. In other words, an error flows into the input of the control system as an input signal when the rotational speed $\omega_L$ of the rotating shaft 20 is fed back and thus stabilization performance of the RCWS 100 may be deteriorated.

In order to stabilize the RCWS 100, the rotational angle $\theta_L$ of the load 27 is made to be 0. When a transfer function using the rotational angle $\theta_L$ of the load 27 as an output value and the compensation torque signal $T_m$ of the driving unit 30 as an input value is obtained from Equations 10 and 11, the transfer function may be expressed by Equations 14 and 15.

$$\theta_L=\frac{(N-1)NK_{eq,m}}{p(s)}J_m\alpha_h+\frac{NK_{eq,m}}{p(s)}T_m+\frac{\{J_ms^2+K_{eq,m}\}}{p(s)}T_d \quad \text{[Equation 14]}$$

-continued $$p(s)=J_mJ_os^4\{s^2+\omega_p^2\}, \quad \text{[Equation 15]}$$

$$\omega_p^2=\frac{(J_o+N^2J_m)K_{eq,m}}{J_mJ_o}$$

In Equation 14, "$\alpha_h$" denotes an angular acceleration obtained by differentiating the rotational speed $\omega_h$ of the main body 400. When a value of the compensation torque signal $T_m$ to remove an angular acceleration component is obtained from Equation 14, the value may be expressed by Equation 16.

$$T_m=-(N-1)J_m\alpha_h \quad \text{[Equation 16]}$$

Equation 16 may be independently used for each of the yaw direction and the elevation direction. The compensation torque signal $T_m$ for motor torque corresponding to each direction is all independently calculated and used. Thus, a motor for driving the RCWS 100 in the yaw direction and a motor for driving the RCWS 100 in the elevation direction each may be independently driven and controlled.

All equations for compensating for a disturbance angular speed of the main body 400 may be identically applied to both of the yaw direction and the elevation direction.

When Equation 16 is substituted into Equation 14, a transfer function using the rotational angle $\theta_L$ of the load 27 as an output value and having the disturbance torque $T_d$ may be expressed by Equation 17.

$$\theta_L=\frac{\{J_ms^2+K_{eq,m}\}}{p(s)}T_d \quad \text{[Equation 17]}$$

Equation 17 signifies that the rotational angle $\theta_L$ of the load 27 for controlling stabilization may become 0 by designing the control system for controlling the RCWS 100 in order to set the compensation torque signal $T_m$ of the driving unit 30 to remove an error due to movement of the main body 400, and simultaneously to reduce an influence of the disturbance torque $T_d$ in the control system for controlling the RCWS 100.

To reduce an influence of the disturbance torque $T_d$, an imbalanced moment of the load 27 and friction needs to be reduced during the design of the control system for controlling the RCWS 100. Further, the stabilization control unit 51 of FIG. 3 may be designed to remove an influence of the disturbance torque $T_d$.

Figure 8:
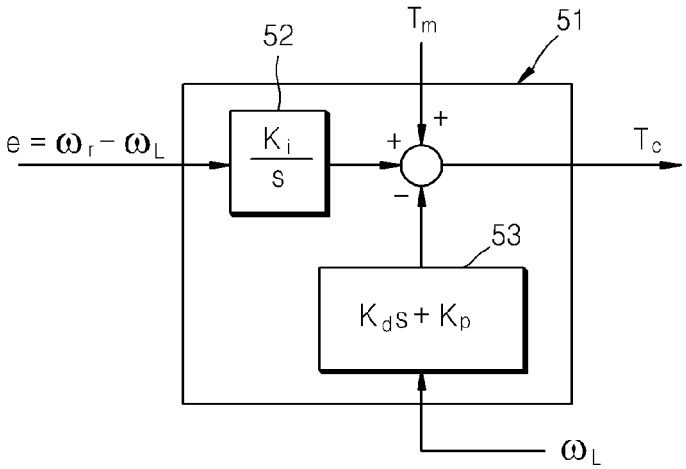
FIG. 8 is a block diagram illustrating a stabilization control unit of the rotating shaft control system of FIG. 1A.

FIG. 8 is a block diagram illustrating the stabilization control unit 51 of the rotating shaft control system of FIG. 1A. Referring to FIG. 8, the stabilization control unit 51 included in the rotating shaft control system of FIG. 1A may be embodied in a variety of types and FIG. 8 illustrates an example of various embodiments thereof. The stabilization control unit 51 may include an integral controller 52 for integrating a difference $e=(\omega_r-\omega_L)$ between the rotational speed $\omega_L$, that is, a speed of the load 27, and the stabilization input signal $\omega_r$ and a proportional-derivative controller 53 using the rotational speed $\omega_L$ of the rotating shaft 20 as an input. The stabilization control unit 51 may output a control signal Tc by adding the compensation torque signal $T_m$ and an output signal of the integral controller 52 and subtracting an output signal of the proportional-derivative controller 53 therefrom.

The embodiment of the rotating shaft control system of FIG. 1A is not limited to the detailed structure of the stabilization control unit 51 of FIG. 8 and may be modified to other types. For example, the stabilization control unit 51 may include at least one of a proportional controller, an integral controller, and a derivative controller.

Figure 9:
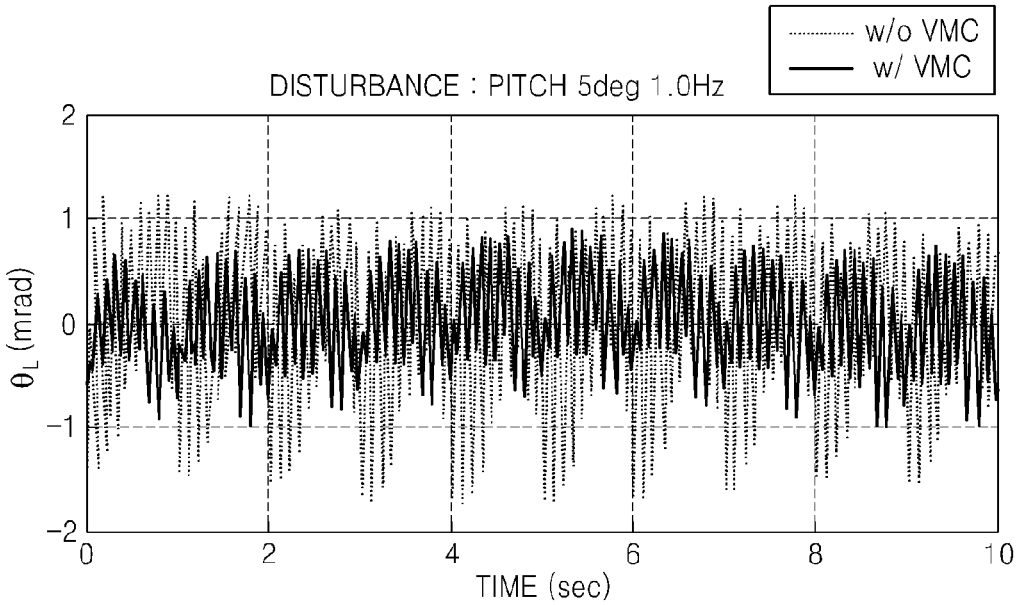
FIG. 9 is a graph showing a degree of stabilization accuracy when a pitch motion having a size of 1 Hz is applied to a main body in the rotating shaft control system of FIG. 3.
Figure 10:
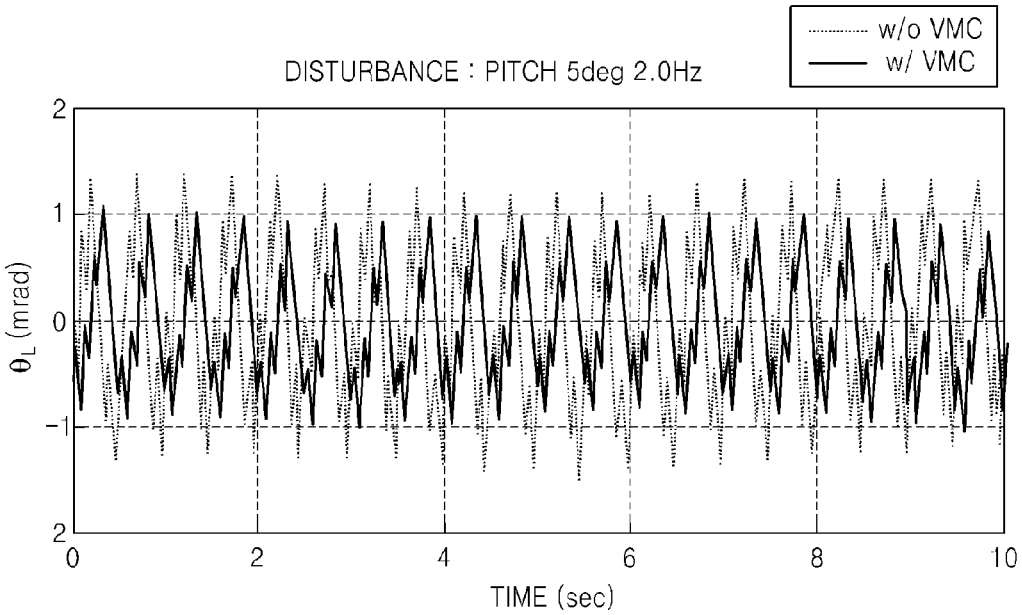
FIG. 10 is a graph showing a degree of stabilization accuracy when a pitch motion having a size of 2 Hz is applied to a main body in the rotating shaft control system of FIG. 3.

FIG. 9 is a graph showing a degree of accuracy with respect to stabilization when a pitch motion having a size of 1 Hz is applied to the main body 400 in the rotating shaft control system of FIG. 3. FIG. 10 is a graph showing a degree of accuracy with respect to stabilization when a pitch motion having a size of 2 Hz is applied to the main body 400 in the rotating shaft control system of FIG. 3.

In FIGS. 9 and 10, a line "w/VMC" indicates a result when the motion compensation unit 55 of FIG. 3 is operated to perform a motion compensation function, and a line "w/o VMC" indicates an influence of a motion of the main body 400 on a degree of accuracy with respect to stabilization when the motion compensation unit 55 is not operated. A pitch motion is applied to the main body 400 by using a simulator with 6 degrees of freedom.

Table 1 indicates results of measurement of a stabilization precision degree indicated in FIGS. 9 and 10. It can be seen that a stabilization precision degree is improved when the rotating shaft control system according to the present embodiment is in use by 42% with respect to the maximum when the rotating shaft control system is not used.

TABLE 1

| Disturbance Frequency | | Stabilization Precision Degree (mrad RMS) | | |
|---|---|---|---|---|
| | | Vehicle motion compensation not applied | Vehicle motion compensation applied | Remarks |
| Vehicle Pitch Motion Disturbance | 1.0 Hz | 0.73 | 0.42 (Decreased by 0.31) | Improved by 42% |
| | 2.0 Hz | 0.72 | 0.53 (Decreased by 0.19) | Improved by 26% |

As described above, according to the rotating shaft control system according to the above-described embodiments, an error component generated when a rotational motion of a main body is transferred to a mechanical system may be effectively removed by the operation of the motion compensation unit and the stabilization control unit so that a degree of accuracy with respect to stability is improved.

While this invention has been particularly shown and described with reference to exemplary embodiments thereof, it will be understood by those skilled in the art that various changes in form and details may be made therein without departing from the spirit and scope of the invention as defined by the appended claims. The exemplary embodiments should be considered in a descriptive sense only and not for purposes of limitation.

What is claimed is:

1. A rotating element control system comprising:

a rotating element rotatably disposed on a main body;

a first measuring unit configured to measure an angular acceleration of the main body;

a driving unit which drives the rotating element;

a second measuring unit which measures a rotational speed of the rotating element;

a transfer unit connecting the rotating element and the driving unit and configured to transfer a driving force to the rotating element at a gear ratio;

a motion compensation unit configured to generate a compensation signal which removes an error component generated by the angular acceleration of the main body; and a stabilization control unit configured to control the driving unit based on the compensation signal and a difference between an stabilization input signal for controlling the driving unit and the rotational speed of the rotating element, wherein the compensation signal comprises a compensation torque signal calculated according to an equation, $T_m=-(N-1)J_m\alpha_h$, to offset the error component generated by the main body, where N is the gear ratio of the transfer unit, $J_m$ is a rotational inertia mass of the driving unit and $\alpha_h$ is the angular acceleration of the main body.

2. The rotating element control system of claim 1, wherein the stabilization control unit comprises at least of a proportional controller, an integral controller, and a derivative controller.

3. The rotating element control system of claim 1, wherein the stabilization control unit comprises:

an integral controller configured to integrate the difference between the rotational speed of the rotating shaft and the stabilization input signal; and a proportional-derivative controller configured to receive the rotational speed of the rotating element as an input.

4. The rotating element control system of claim 1, wherein the motion compensation unit is configured to generate the compensation signal in a yaw direction.

5. The rotating element control system of claim 4, wherein the motion compensation unit is configured to generate the compensation signal further in an elevation direction.

6. The rotating element control system of claim 1, wherein the motion compensation unit is configured to generate the compensation signal in an elevation direction.

7. The rotating element control system of claim 1, wherein the stabilization input signal is a signal which includes an error value caused by the movement of the main body.

8. The rotating element control system of claim 1, wherein the stabilization control unit is configured to generate a control signal based on the stabilization input signal, the rotational speed of the rotating element and the compensation signal.

9. The rotating element control system of claim 8, wherein the control signal is generated by adding the compensation signal and an output signal of the integral controller based on the difference between the rotational speed of the rotating element and the stabilization input signal and subtracting an output signal of the proportional-derivative controller.

10. A method of reducing influence of a rotational motion of a main body transferred to a mechanical system by a rotating element control system, the method comprising:

measuring a rotational acceleration of the main body by a first sensor;

calculating a compensation signal based on the rotational acceleration of the main body, a gear ratio of a transfer unit, and a rotational inertia mass of a driving unit by a motion compensation unit;

measuring a rotational speed of a rotating element by a second sensing unit;

receiving an input signal;

generating a control signal based on the input signal, the rotational speed of the rotating element and the compensation signal; and outputting the control signal to the mechanical system, wherein the compensation signal comprises a compensation torque signal calculated according to an equation, $T_m=-(N-1)J_m\alpha_h$, to offset the error component generated by the main body, where N is the gear ratio of the transfer unit, $J_m$ is a rotational inertia mass of the driving unit and $\alpha_h$ is the angular acceleration of the main body.

11. The method of claim 10, wherein the mechanical system comprises: the driving unit, the transfer unit and the rotating element.

12. The method of claim 10, wherein the generating the control signal comprises adding the compensation signal and an output signal of the integral controller based on the difference between the rotational speed of the rotating element and the input signal and subtracting an output signal of the proportional-derivative controller.

13. The method of claim 12, wherein the control signal is generated by adding the compensation signal and an output signal of the integral controller and subtracting an output signal of the proportional-derivative controller.

14. A rotating element control system comprising:

a control unit configured to receive an angular acceleration of a main body, an input signal and an angular speed of a rotating element, configured to calculate a compensation signal, and configured to output the compensation signal, wherein the control unit comprising:

a motion compensation unit; and a stabilization control unit; and a mechanical system comprising:

a driving unit configured to drive the rotating element; and a transfer unit connecting the rotating element and the driving unit and configured to transfer a driving force to the rotating element at a gear ratio, wherein the compensation signal comprises a compensation torque signal calculated according to an equation, $T_m=-(N-1)J_m\alpha_h$, to offset the error component generated by the main body, where N is the gear ratio of the transfer unit, $J_m$ is a rotational inertia mass of the driving unit and $\alpha_h$ is the angular acceleration of the main body.

15. The rotating element control system of claim 14, wherein the stabilization control unit is configured to generate a control signal based on the input signal, the rotational speed of the rotating element and the compensation signal.

16. The rotating element control system of claim 15, wherein the control signal is generated by adding the compensation signal and an output signal of the integral controller based on the difference between the rotational speed of the rotating element and the input signal and subtracting an output signal of the proportional-derivative controller.

* * * * *